US007452237B1

(12) United States Patent
Montena

(10) Patent No.: US 7,452,237 B1
(45) Date of Patent: Nov. 18, 2008

(54) COAXIAL CABLE COMPRESSION CONNECTOR

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/023,265

(22) Filed: Jan. 31, 2008

(51) Int. Cl.
*H01R 9/05* (2006.01)

(52) U.S. Cl. ..... 439/578

(58) Field of Classification Search ..... 439/578, 439/583, 584
See application file for complete search history.

(56) References Cited

U.S. PATENT DOCUMENTS

| | | | | |
|---|---|---|---|---|
| 5,470,257 | A | 11/1995 | Szegda | |
| 6,032,358 | A | 3/2000 | Wild | |
| 6,146,197 | A | 11/2000 | Holliday | |
| 6,210,222 | B1 | 4/2001 | Langham | |
| 6,261,126 | B1 | 7/2001 | Stirling | |
| 6,267,621 | B1 * | 7/2001 | Pitschi et al. | 439/584 |
| 6,425,782 | B1 | 7/2002 | Holland | |
| 6,530,807 | B2 * | 3/2003 | Rodrigues et al. | 439/578 |
| 6,648,683 | B2 * | 11/2003 | Youtsey | 439/578 |
| 6,767,249 | B1 | 7/2004 | Li | |
| 6,805,584 | B1 | 10/2004 | Chen | |
| 6,817,896 | B2 | 11/2004 | Derenthal | |
| D504,664 | S | 5/2005 | Montena | |
| 6,905,365 | B1 | 6/2005 | Liu | |
| 7,112,093 | B1 | 9/2006 | Holland | |
| 7,241,172 | B2 | 7/2007 | Rodrigues | |
| 7,264,502 | B2 | 9/2007 | Holland | |
| 7,288,002 | B2 * | 10/2007 | Rodrigues et al. | 439/578 |
| 7,297,023 | B2 * | 11/2007 | Chawgo | 439/578 |
| 7,309,255 | B2 * | 12/2007 | Rodrigues | 439/578 |
| 7,347,729 | B2 * | 3/2008 | Thomas et al. | 439/583 |
| 2004/0147164 | A1 * | 7/2004 | Li | 439/578 |
| 2005/0208827 | A1 | 9/2005 | Burris | |
| 2007/0049113 | A1 * | 3/2007 | Rodrigues et al. | 439/578 |

* cited by examiner

*Primary Examiner*—Neil Abrams
*Assistant Examiner*—Phuong Nguyen
(74) *Attorney, Agent, or Firm*—Patents Innovations LLC; John M. Hammond

(57) ABSTRACT

A coaxial cable connector comprising a fastener, a tubular post, and a compression sleeve. The fastener is comprised of a forward end and a rearward end, and includes an axial bore therethrough having a first and second engagement surfaces. The tubular post is comprised of a first engagement portion located in the axial bore at the forward end of the fastener, and a tubular extension extending rearwardly from the first engagement portion. The compression sleeve is configured to receive a prepared coaxial cable, and is movable between first and second positions. In the first position, a first end of the compression sleeve is engaged with the first engagement surface. Axial advancement of the compression sleeve to the second position causes the first end of the compression sleeve to engage with the second engagement surface of the fastener. A method of securing a coaxial cable in the connector is also disclosed.

14 Claims, 3 Drawing Sheets

COAXIAL CABLE COMPRESSION CONNECTOR

BACKGROUND OF THE INVENTION

1. Field of the Invention

The present invention relates generally to coaxial cable end connectors of the type employed in the cable television industry. More particularly, the present invention relates to a compression connector that has minimal parts and a low manufacturing cost.

2. Description of Related Art

A conventional coaxial cable typically is comprised of a centrally located inner electrical conductor surrounded by and spaced inwardly from an outer cylindrical electrical conductor. The inner and outer conductors are separated by a dielectric insulating sleeve, and the outer conductor is encased within a protective dielectric jacket. The outer conductor can comprise a sheath of fine braided metallic strands, a metallic foil, or multiple layer combinations of either or both.

A typical coaxial compression connector includes four parts: a connector body, a threaded fastener for securing the connector to an equipment port such as a radio frequency (RF) port, a tubular post contained within the connector body, and a compression sleeve. For example, U.S. Pat. No. 5,470,257 to Szegda, which is assigned to the assignee of the present invention and incorporated herein by reference, discloses a compression type coaxial cable end connector comprising a connector body having a tubular inner post extending from a front end to a rear end, and including an outer collar surrounding and fixed relative to the inner post at a location disposed rearwardly of the front post end. The outer collar cooperates with the inner post to define an annular chamber with a rear opening. A fastener at the front end of the inner post serves to attach the end connector to a system component. A tubular locking member protrudes axially into the annular chamber through its rear opening.

Additionally, U.S. Pat. No. 7,241,172 to Rodrigues et al., the disclosure of which is incorporated herein by reference, describes a coaxial cable connector with three parts: an annular post having an axial bore, a cylindrical collar movably coupled to the post, and a nut rotatably coupled to the post. The cylindrical collar locks directly to an enlarged outer portion of the post to retain the prepared end of a coaxial cable.

There remains a need for a coaxial compression connector that is easy to assemble onto a prepared cable end, that locks securely on the cable end with a high holding strength, and that has a minimal number of parts that are manufacturable with high precision in high volumes at low cost.

SUMMARY OF THE INVENTION

The present invention meets this need by providing a coaxial cable connector for connecting a coaxial cable to an RF port. The coaxial cable connector is comprised of a fastener, a tubular post, and a compression sleeve. The fastener is comprised of a forward end and a rearward end, and includes an axial bore therethrough having a first engagement surface and a second engagement surface. The tubular post is comprised of a first engagement portion located in the axial bore proximate to the forward end of the fastener, and a tubular extension extending rearwardly from the first engagement portion. The compression sleeve is configured to receive a prepared coaxial cable, and is movable between a first position and a second position. In the first position, also referred to herein as the unlocked position, a first end of the compression sleeve is engaged with the first engagement surface. Axial advancement of the compression sleeve to the second position, also referred to herein as the locked position, causes the first end of the compression sleeve to engage with the second engagement surface of the fastener and engage the first engagement portion of the tubular post. Axial advancement of the compression sleeve to the second position may also cause the first end of the compression sleeve to compress the tubular post against the RF port.

In one preferred embodiment, the first engagement surface of the fastener is a first annular groove, the second engagement surface of the fastener is a second annular groove, and the first end of the compression sleeve is comprised of an annular rib. The annular rib engages with the first annular groove when the compression sleeve is placed in the first position. When the compression sleeve is advanced to the second position, the annular rib engages with the second annular groove.

In another preferred embodiment, the tubular extension of the tubular post is comprised of an annular barb, and the compression sleeve is comprised of an inner bore therethrough having a region of reduced diameter. When the compression sleeve is advanced to the second position, the annular barb of the tubular post and the region of reduced diameter of the bore coact to form a constriction between them. The constriction serves to firmly hold a coaxial cable installed within the connector. The axial advancement of the compression sleeve to the second position causes the first end to engage the second engagement surface and the compression sleeve to compress the coaxial cable radially inwardly against the post.

The inner bore of the compression sleeve of the connector may include a bevel at the second end thereof, which enables ease of insertion of a prepared coaxial cable end into the connector. The second end of the compression sleeve may also include an annular flange. The first end of the compression sleeve may further comprise a plurality of axial slots that permit the first end to deform radially inwardly when moving the compression sleeve from the first position to the second position.

The first engagement portion of the tubular post may be engaged within the axial bore of the fastener in a close-tolerance sliding fit. The fastener is preferably a nut-type fastener, wherein a portion of the axial bore of the fastener proximate to the forward end is comprised of threads that are engageable with corresponding threads of a cable television component or other system component. To facilitate the threading and tightening of the connector on a system component by hand, the exterior surface of the fastener may be provided with a plurality of gripping features for firm engagement with the user's fingers.

In accordance with the invention, there is also provided a method for terminating an end of a coaxial cable within a coaxial cable connector. The coaxial cable is comprised of a center conductor surrounded by an insulator, a conductive shield surrounding the insulator, and an insulative jacket surrounding the conductive shield. The method comprises providing the instant cable connector as recited herein, making a prepared end of a coaxial cable, inserting the prepared end of the coaxial cable into the connector, and moving the compression sleeve forwardly from the first to the second position to secure the cable within the connector. The connector comprises a fastener comprised of a forward end and a rearward end and including an axial bore therethrough having a first engagement surface and a second engagement surface; a tubular post comprised of a first engagement portion located in the axial bore proximate to the forward end of the fastener, a tubular extension extending rearwardly from the first engagement portion, and a central bore extending through the first engagement portion and the tubular extension; and a compression sleeve movable between a first position and a second position, the compression sleeve in the first position having a first end engaged with the first engagement surface.

The prepared cable end may be made by stripping a first extent of insulator, conductive shield, and insulative jacket to expose a length of center conductor, stripping a second extent of insulative jacket to expose a length of conductive shield, and folding back the exposed length of conductive shield axially along the insulative jacket. The prepared end of the coaxial cable is inserted into the connector through the compression sleeve and into the rearward end of the fastener, such that the central bore of the tubular post receives a portion of the center conductor and insulator, and the exposed length of conductive shield is proximate to the first engagement portion of the tubular post. The compression sleeve is moved forwardly within the axial bore of the fastener from the first position until the first end of the compression sleeve engages with the second engagement surface of the fastener.

The tubular extension of the tubular post of the connector may be comprised of an annular barb and the compression sleeve may be comprised of an inner bore therethrough having a region of reduced diameter, such that a constriction is formed between the annular barb and the region of reduced diameter. With such a connector embodiment, the method further comprises binding the cable within the constriction to hold it securely within the connector.

The foregoing and additional objects, advantages, and characterizing features of the present invention will become increasingly more apparent upon a reading of the following detailed description together with the included drawings.

BRIEF DESCRIPTION OF THE DRAWINGS

The present invention will be described by reference to the following drawings, in which like numerals refer to like elements, and in which.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DETAILED DESCRIPTION OF THE PREFERRED EMBODIMENTS

Figure 1:
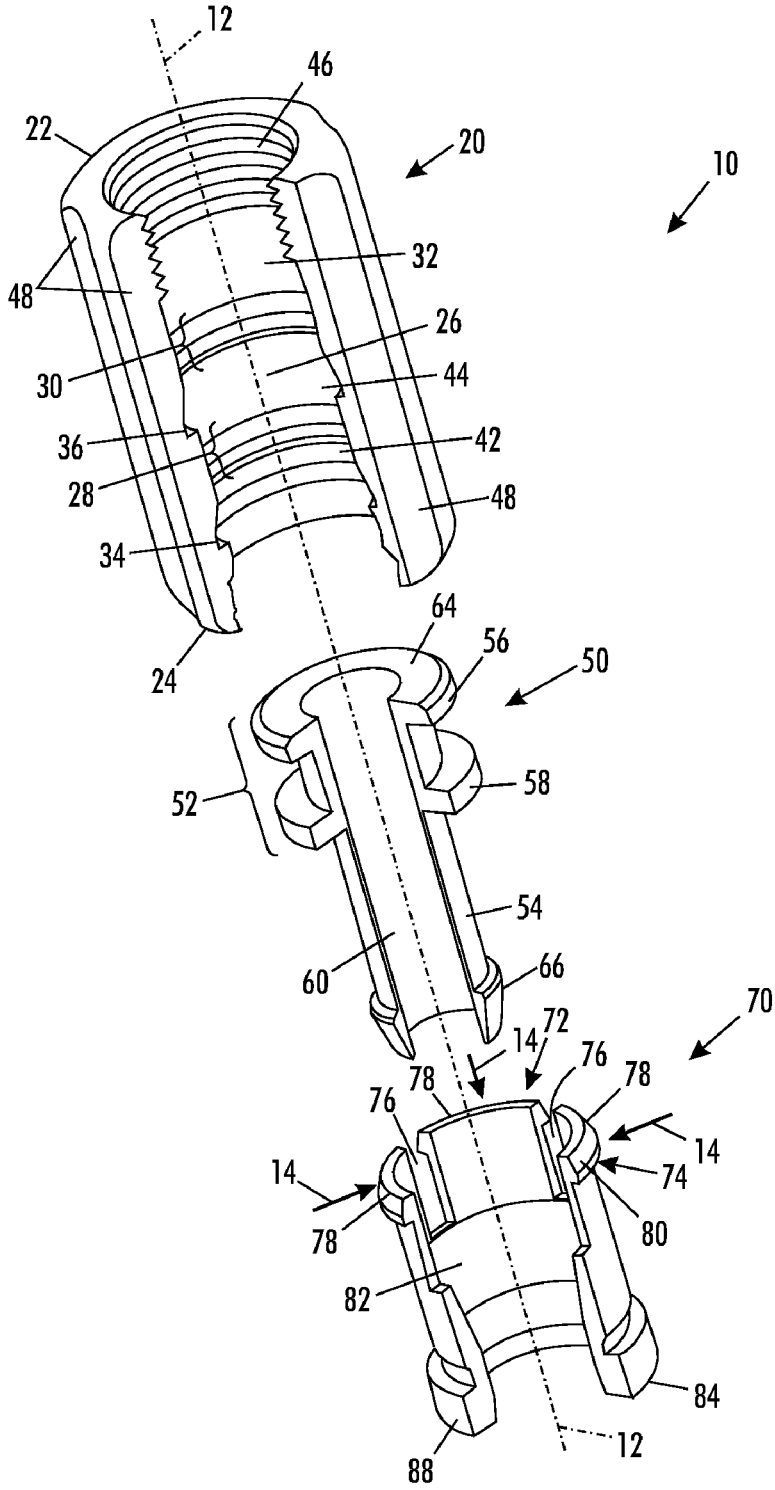
FIG. 1 is an exploded perspective view of a connector of the present invention, with arcuate portions of the respective fastener, tubular post, and compression sleeve of the connector cut away.
Figure 2:
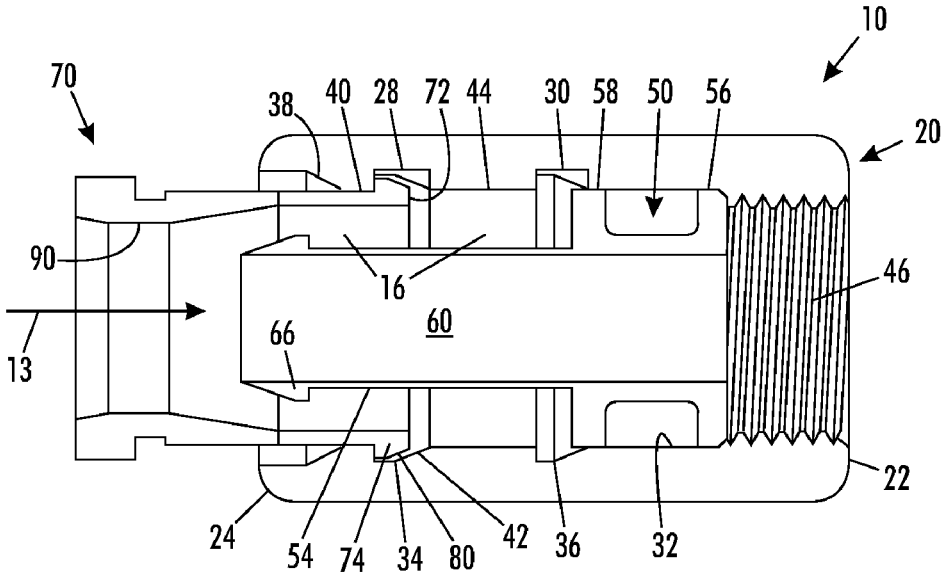
FIG. 2 is a cross-sectional view of the connector of FIG. 1 with the compression sleeve in an unlocked position with respect to the fastener.
Figure 3:
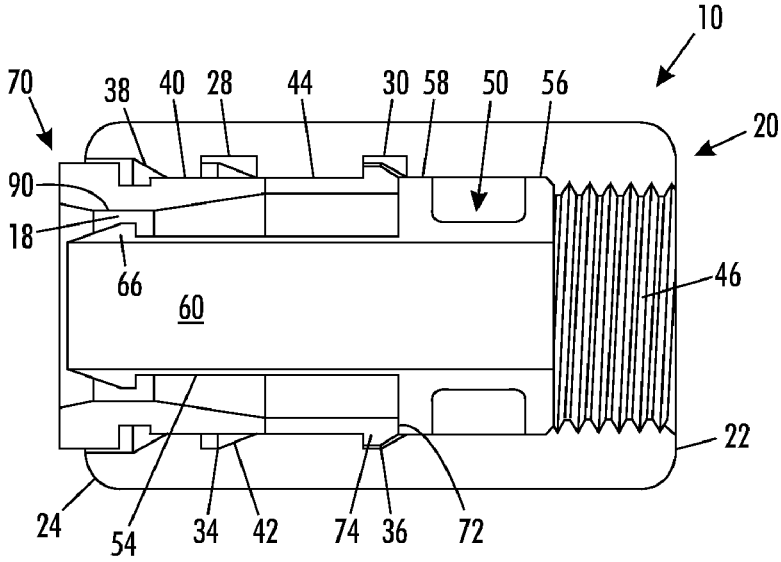
FIG. 3 is a cross-sectional view of the connector of FIG. 1 with the compression sleeve advanced to a locked position with respect to the fastener.

Referring first to FIGS. 1-3, coaxial cable connector 10 is comprised of a fastener 20, a tubular post 50, and a compression sleeve 70. The fastener 20 is comprised of a forward end 22 and a rearward end 24, and includes an axial bore 26 therethrough oriented along the central axis 12 of the connector 10. The axial bore 26 includes a first engagement surface 28 and a second engagement surface 30 for engagement with the compression sleeve 70, as will be explained subsequently.

The tubular post 50 is comprised of a first engagement portion 52 located in region 32 of the axial bore 26 proximate to the forward end 22 of the fastener 20, and a tubular extension 54 extending rearwardly from the first engagement portion 52 and including a central bore 60 therethrough. In the embodiment depicted in FIGS. 1-3, the first engagement portion 52 is comprised of a first flange 56 and a second flange 58. Alternatively, the first engagement portion 52 may be a cylinder extending over the length of the tubular post 50 defined by first flange 56 and second flange 58.

The axial bore 26 of the fastener 20 is provided with a region 32 that is preferably of constant diameter. This diameter is made slightly greater than the diameters of the respective first and second flanges 56 and 58. In that manner, the tubular post 50 may be engaged with the fastener 20, with the first engagement portion 52 of the tubular post 50 engaging with the region 32 of constant diameter of the fastener 20 in a close-tolerance sliding fit.

In one embodiment, the tubular post 50 and the fastener 20 are made as separate parts that are assembled together. This is because the tubular post 50 preferably should be able to rotate freely within the fastener 20, so that the cable installed therein does not become twisted when attaching the connector 10 to an RF port. In another embodiment, the fastener 20 may be molded around the tubular post 50, provided that the tubular post 50 is made rotatable within the fastener 20. This may be accomplished by applying a small amount of mold release agent to the first and second flanges 56 and 58, prior to the molding process.

The tubular post 50 is formed from a conductive material, such as a metal, in order to maintain the continuity of the electromagnetic shield provided by the outer conductor of the coaxial cable. One preferred material for the tubular post 50 is brass. In contrast, the fastener 20 is made of a low-cost material that can be easily and inexpensively formed with precise dimensional tolerances. The fastener 20 must also engage with the compression sleeve 70 in a manner that is fixed in the axial direction while allowing rotational slippage therewith. Thus the fastener 20 must have a low coefficient of friction with the compression sleeve 70. Moldable plastic materials are preferred for making the fastener 20. One preferred plastic material is DELRIN®, an acetal polyoxymethylene resin manufactured and sold by the E.I. du Pont de Nemours and Company of Wilmington, Del. Other suitable plastic materials include but are not limited to acrylonitrile butadiene styrene (ABS), polyetheretherketone (PEEK), and polyimides.

The compression sleeve 70 is configured to receive a prepared coaxial cable, and is movable between a first unlocked position and a second locked position. FIG. 2 is a cross-sectional view of the connector 10 with the compression sleeve 70 in the unlocked position with respect to the fastener 20. In this unlocked position, the first end 72 of the compression sleeve 70 is engaged with the first engagement surface 28 of the fastener 20. FIG. 3 depicts the compression sleeve 70 advanced to the locked position with respect to the fastener 20. The axial advancement of the compression sleeve 70 to the locked position causes the first end 72 of the compression sleeve 70 to disengage with the first engagement surface 28 and to engage with the second engagement surface 30 of the fastener 20.

In a preferred embodiment depicted in FIGS. 1-3, the first engagement surface 28 of the fastener 20 is a first annular groove 34, the second engagement surface 30 of the fastener 20 is a second annular groove 36, and the first end 72 of the compression sleeve 70 is comprised of an annular rib 74 dimensioned to be received by the first and second annular grooves 34 and 36. The annular rib 74 engages with the first annular groove 34 when the compression sleeve 70 is placed in the unlocked position. When the compression sleeve 70 is advanced to the locked position as indicated by arrow 13 of FIG. 2, the annular rib 74 disengages with the first annular groove 34 and engages with the second annular groove 36.

To facilitate the assembly of the compression sleeve 70 with the fastener 20, the first end 72 of the compression sleeve 70 may further comprise a plurality of axial slots 76. These slots 76 subdivide the annular rib 74 into separate sectors or fingers 78. (It is noted that in FIG. 1, compression sleeve 70 is comprised of four axial slots 76, and four annular rib sectors or fingers 78. Because of the cut away view, only two slots 76 and three fingers 78 are shown.) The axial slots 76 permit the fingers 78 of the first end 72 to be displaced radially inwardly as indicated by arrows 14 when moving the compression sleeve 70 into the unlocked position with respect to fastener 20, and then into the locked position. It will be apparent that the axial slots 76 could be shaped other than as shown in FIG. 1; for example, the axial slots 76 could be V-shaped.

Annular rib 74 is preferably comprised of a shoulder and a forward-facing taper 80 that further facilitates the insertion of the compression sleeve 70 into the fastener 20. When the insertion is performed, the forward facing taper 80 contacts a rearward facing bevel 38 provided in the axial bore 26 of the fastener 20, thereby deforming the fingers 78 inwardly as described previously. The fingers 78 slide along a first section 40 of axial bore 26, and then snap radially outwardly to engage with the first annular groove 34. Thus in the first unlocked position, the first end 72 of the compression sleeve 70 is engaged with the first engagement surface 28 of the fastener 20.

In like manner, the first annular groove 34 is comprised of a rearward facing bevel 42. When the compression sleeve 70 is advanced from the unlocked position (FIG. 2) to the locked position (FIG. 3), the forward facing taper 80 contacts the rearward facing bevel 42 of the annular groove 34, thereby again deforming the fingers 78 inwardly. The fingers 78 slide along a second section 44 of axial bore 26, and then snap radially outwardly to engage with the second annular groove 36. Thus in the second locked position, the first end 72 of the compression sleeve 70 is engaged with the second engagement surface 30 of the fastener 20.

The fastener 20 and the compression sleeve 70 may be provided with means for engagement with each other which differ from that shown in FIGS. 1-3. In one embodiment, the means for engagement could be the reverse of what is shown. In other words, the first engagement surface 28 of fastener 20 could be a first annular rib instead of a first annular groove 34, and the second engagement surface 30 could be a second annular rib instead of a second annular groove 36. The end 72 of compression sleeve 70 could be formed with a corresponding annular groove, or a shoulder that would engage with the first annular rib of the fastener 20 in the unlocked position, and with the second annular rib of the fastener 20 in the locked position.

Additional features of the instant connector, and a method of terminating an end of a coaxial cable within the connector will now be described. The features and method are best understood with reference to FIGS. 4-6.

Figure 4:
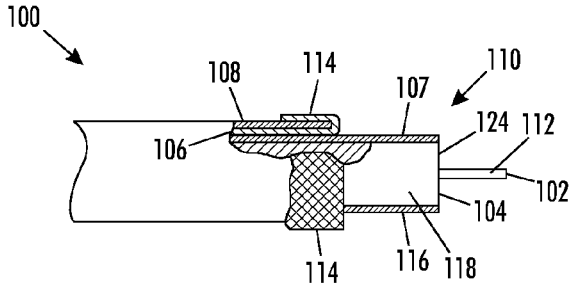
FIG. 4 is a side view of a prepared end of a coaxial cable.

FIG. 4 is a side view of an end of a coaxial cable 100 that has been prepared for termination within the connector 10. The coaxial cable 100 is comprised of a central electrical conductor 102 formed of copper or other suitably conductive material. The center conductor 102 is encased in an insulator 104 formed of a suitably insulative material such as plastic, which in turn is surrounded by a conductive shield 106. A protective insulative jacket 108 encases the conductive shield 106. The conductive shield 106 is typically made from fine braided metallic strands, and may further include a metallic foil 107, or multiple layer combinations of either or both.

The prepared cable end 110 may be made by stripping a first extent of insulator 104, conductive shield 106, and insulative jacket 108 to expose a length 112 of center conductor 102, stripping a second extent of insulative jacket 108 to expose a length 114 of conductive shield 106, and folding back the exposed length 114 of conductive shield 106 axially along the insulative jacket 108. If the conductive shield 106 includes a metallic foil 107, a portion 116 of the foil 107 may extend from the folded-back length 114 of conductive shield 106 along the exposed length 118 of insulator 104.

Figure 5:
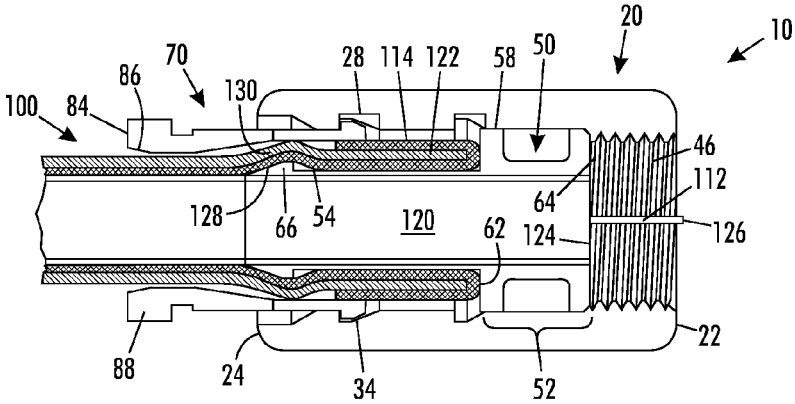
FIG. 5 is a is a cross-sectional view of the connector with the compression sleeve in the unlocked position with respect to the fastener, and the prepared end of the coaxial cable disposed within the connector.

Referring now to FIG. 5, to terminate the coaxial cable 100 within the coaxial cable connector 10, the prepared end 110 of the coaxial cable 100 is inserted into the connector 10 through the inner bore 82 of the compression sleeve 70 and into the rearward end 24 of the fastener 20. To facilitate the insertion of the prepared cable end 110 into the second end 84 of the compression sleeve 70, the inner bore 82 thereof may include a bevel 86 at the second end 84. During the insertion of the prepared end 110 into the connector 10, the compression sleeve 70 may be engaged with the fastener 20 in the unlocked position as shown in FIG. 5. Alternatively, the compression sleeve 70 may be separate from the fastener 20, such that the prepared end 110 is first inserted through the inner bore 82 of the compression sleeve and into the fastener 20. The compression sleeve 70 may then be axially advanced to the unlocked position, wherein the annular rib 74 is engaged with the first annular groove 34.

In either case, when the prepared cable end 110 is inserted into the fastener 20, the central bore 60 (FIG. 2) of the tubular post 50 receives a portion 120 of the center conductor 102 and insulator 104. The tubular extension 54 of the tubular post 50 penetrates between the insulator 104 and the conductive shield 106, such that the folded back length 114 of conductive shield and the end region 122 of insulative jacket 108 are contained within the annular space 16 (FIG. 2) formed between the axial bore 26 of the fastener 20 and the tubular extension 54 of the tubular post 50. Upon completion of the insertion of the prepared cable end 110 into the fastener 20, the forward most exposed length 114 of conductive shield 106 is proximate to the first engagement portion 52 of the tubular post 50. More preferably, cable end 110 is prepared such that when it is fully inserted into the fastener 20, the forward most exposed length 114 of conductive shield 106 is abutted against the rear surface 62 of the second flange 58; and the forward most surface 124 of the exposed length 118 of insulator 104 is approximately coplanar with the forward end 64 of the tubular post; and the forward most tip 126 of the exposed length 112 of center conductor 102 is approximately coplanar with the end 22 of the fastener 20.

Figure 6:
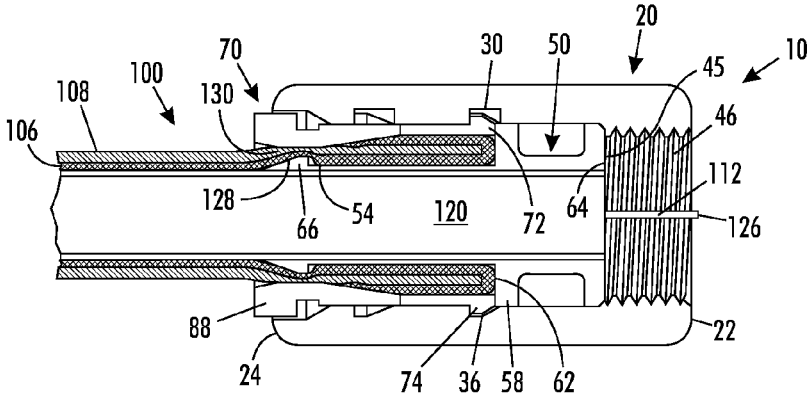
FIG. 6 is a cross-sectional view of the connector with the compression sleeve having been moved to the locked position with respect to the fastener, and the prepared end of the coaxial cable fully installed within the connector.

Referring now to FIG. 6, to complete the termination of the coaxial cable 100 within the coaxial cable connector 10, the compression sleeve 70 is moved forwardly within the axial bore 26 of the fastener 20 from the unlocked position until the first end 72 of the compression sleeve 70 engages with the second engagement surface 30 of the fastener 20. For the connector 10 of FIG. 6, annular rib 74 engages with second annular groove 36. The movement of the compression sleeve 70 may be performed by hand (i.e. the installer's fingers), or by the use of a suitably configured plier-like tool (not shown). The second end 84 of the compression sleeve 70 may include an annular flange 88 for receiving the force from the installer's fingers or the tool.

The end 72 of the compression sleeve 70 is preferably dimensioned such that when the compression sleeve 70 is advanced axially to the second position, the end 72 thereof engages with the rear surface 62 of the second flange 58 of the tubular post 50. Thus the tubular post 50 is forced into a forwardmost position in the axial bore 26 of the fastener 20, such that the forward end 64 of the tubular post 50 is contiguous with the inner end 45 of the threads 46 of the fastener 20. When the fastener 20 is engaged with a correspondingly threaded RF port (not shown), the outer edge of the RF port will "bottom out" or abut against the forward end 64 of the tubular post 50. Thus when the connector 10 is in use, the axial advancement of the compression sleeve 70 to the second position causes the first end 72 thereof to engage the second engagement surface 30 of the fastener 20, to engage the first engagement portion 52 of the tubular post 50, and to compress the tubular post 50 against the RF port.

In another preferred embodiment of the instant connector 10, the tubular post 50 and the compression sleeve 70 are configured to form a constriction between them when the compression sleeve 70 is moved to the locked position during the cable termination process. The constriction serves to firmly hold the coaxial cable 100 installed within the connector 10. Referring first to FIGS. 2 and 5, the tubular extension 54 of the tubular post 50 is comprised of an annular barb 66. When the prepared cable end 110 is inserted into fastener 20, the barb 66 deforms a portion 128 of the conductive shield 106 and a portion 130 of the insulative jacket 108 radially outwardly. However, the adjacent region of the inner bore 82 of the compression sleeve 70 is sufficiently large so that the portion 128 of the shield 106 and the portion 130 of the jacket 108 are not constricted between them when the compression sleeve 70 is in the unlocked position.

The inner bore 82 of the compression sleeve 70 is further comprised of a region 90 of reduced diameter. Referring now to FIG. 3, when the compression sleeve 70 is advanced to the locked position, the annular barb 66 of the tubular post 50 and the region 90 of reduced diameter of the inner bore 82 coact to form a constriction 18 between them. Referring also to FIG. 6, it can be seen that the portion 128 of the shield 106 and the portion 130 of the jacket 108 have been severely deformed within constriction 18, and that the annular barb 66 has dug into the shield 106. The axial advancement of the compression sleeve 70 to the second position simultaneously causes the first end 72 thereof to engage the second engagement surface 30, and the compression sleeve 70 to compress the coaxial cable 100 radially inwardly against the post 50. Thus the cable 100 is bound within the constriction 18 and held securely within the connector 10.

Like fastener 20, compression sleeve 70 is preferably made of a low-cost material that can be easily and inexpensively formed with precise dimensional tolerances. The materials previously recited for the fabrication of fastener 20 are also suitable for compression sleeve 70. Each of these materials has a low coefficient of friction when contacted with itself. Thus, when fastener 20 and compression sleeve 70 are engaged with each other in the locked position, they are firmly held together axially by the engagement of the annular rib 74 with the second annular groove 36, but are rotationally free by means of the plastic-on-plastic bearing interface between them.

The fastener 20 is preferably a nut-type fastener. A portion of the axial bore 26 of the fastener 20 proximate to the forward end is comprised of threads 46 that are engageable with corresponding threads of a cable television component or other system component (not shown). To facilitate the threading and tightening of the connector 10 on a system component by hand, the exterior surface of the fastener 20 may be provided with a plurality of gripping features 48 for firm engagement with the user's fingers. The gripping features 48 may be grooves as shown in FIG. 1, knurling, or other suitable features to enhance grip by the fingers. Additionally, by making the fastener of plastic, the molded threads serve to reduce the amount of torque required to tighten the fastener 20 onto a cable television component. Since a hand tool is not needed to secure the fastener 20 of the connector 10 to the component, damage to the connector 10 and/or the component is avoided.

It is, therefore, apparent that there has been provided, in accordance with the present invention, a coaxial cable connector, and a method for terminating an end of a coaxial cable within the coaxial cable connector. While this invention has been described in conjunction with preferred embodiments thereof, it is evident that many alternatives, modifications, and variations will be apparent to those skilled in the art. Accordingly, the present invention is intended to embrace all such alternatives, modifications and variations that fall within the broad scope of the appended claims.

What is claimed is:

1. A coaxial cable connector for connecting a coaxial cable to an RF port, the coaxial cable connector comprising:

a fastener comprising a forward end and a rearward end and including an axial bore therethrough having a first engagement surface and a second engagement surface;

a tubular post comprising a first engagement portion and a tubular extension extending rearwardly from the first engagement portion, the first engagement portion located in the axial bore proximate to the forward end of the fastener; and a compression sleeve movable between a first position and a second position, the compression sleeve in the first position having a first end engaged with the first engagement surface, the compression sleeve configured to receive a prepared coaxial cable, whereby axial advancement of the compression sleeve to the second position causes the first end to engage the second engagement surface and engage the first engagement portion of the tubular post.

2. The coaxial cable connector of claim 1, wherein the first engagement surface of the fastener is a first annular groove, the second engagement surface of the fastener is a second annular groove, and the first end of the compression sleeve is comprised of an annular rib.

3. The coaxial cable connector of claim 1, wherein the tubular extension of the tubular post is comprised of an annular barb, the compression sleeve is comprised of an inner bore therethrough having a region of reduced diameter, and wherein a constriction is formed between the annular barb and the region of reduced diameter when the compression sleeve is advanced to the second position.

4. The coaxial cable connector of claim 1, wherein the compression sleeve is comprised of a second end, and wherein the inner bore of the compression sleeve has a bevel at the second end.

5. The coaxial cable connector of claim 1, wherein the compression sleeve is comprised of a second end including an annular flange.

6. The coaxial cable connector of claim 1, wherein the first end of the compression sleeve has a plurality of axial slots.

7. The coaxial cable connector of claim 1, wherein a portion of the axial bore of the fastener proximate to the forward end is comprised of threads for engagement with the RF port.

8. The coaxial cable connector of claim 1, wherein the fastener is comprised of an exterior surface including a plurality of gripping features.

9. The coaxial cable connector of claim 1, wherein axial advancement of the compression sleeve to the second position causes the first end to engage the second engagement surface and compress the tubular post against the RF port.

10. The coaxial cable connector of claim 1, wherein axial advancement of the compression sleeve to the second position causes the first end to engage the second engagement surface and the compression sleeve to compress the coaxial cable radially inwardly against the post.

11. A method for terminating an end of a coaxial cable within a coaxial cable connector, the coaxial cable comprising a center conductor surrounded by an insulator, a conductive shield surrounding the insulator, and an insulative jacket surrounding the conductive shield, the method comprising:

providing a coaxial cable connector comprising a fastener comprised of a forward end and a rearward end and including an axial bore therethrough having a first engagement surface and a second engagement surface; a tubular post comprised of a first engagement portion located proximate to the axial bore at the forward end of the fastener, a tubular extension extending rearwardly from the first engagement portion, and a central bore extending through the first engagement portion and the tubular extension; and a compression sleeve movable between a first position and a second position, the compression sleeve in the first position having a first end engaged with the first engagement surface;

making a prepared end of the coaxial cable by stripping a first extent of insulator, conductive shield, and insulative jacket to expose a length of center conductor, stripping a second extent of insulative jacket to expose a length of conductive shield, and folding back the exposed length of conductive shield axially along the insulative jacket;

inserting the prepared end of the cable through the compression sleeve and into the rearward end of the fastener, such that the central bore of the tubular post receives a portion of the center conductor and insulator, and the exposed length of conductive shield is proximate to the first engagement portion of the tubular post; and moving the compression sleeve forwardly within the axial bore of the fastener until the first end of the compression sleeve engages with the second engagement surface of the fastener.

12. The method of claim 11, wherein the tubular extension of the tubular post is comprised of an annular barb and the compression sleeve is comprised of an inner bore therethrough having a region of reduced diameter, and wherein the method further comprises binding the cable in a constriction formed between the annular barb and the region of reduced diameter.

13. A coaxial cable connector comprising:

a fastener comprising a forward end and a rearward end and including an axial bore therethrough having a first engagement surface and a second engagement surface;

a tubular post comprising a first engagement portion and a tubular extension extending rearwardly from the first engagement portion, the first engagement portion located in the axial bore at the forward end of the fastener; and, a compression sleeve configured to receive a prepared coaxial cable and movable between a first position and a second position, the compression sleeve having a first end comprising means for engagement with the first engagement surface and the second engagement surface, whereby axial advancement of the compression sleeve from the first position to the second position disengages the means for engagement with the first engagement surface, and engages the means for engagement with the second engagement surface.

14. The coaxial cable connector of claim 13, wherein the first engagement surface of the fastener is a first annular groove, the second engagement surface of the fastener is a second annular groove, and the means for engagement is comprised of an annular rib.

* * * * *